US010907405B2

(12) United States Patent
Michalczyk

(10) Patent No.: US 10,907,405 B2
(45) Date of Patent: Feb. 2, 2021

(54) RETRACTABLE GATE SYSTEM

(71) Applicant: Timothy John Michalczyk, Ashby, MA (US)

(72) Inventor: Timothy John Michalczyk, Ashby, MA (US)

( * ) Notice: Subject to any disclaimer, the term of this patent is extended or adjusted under 35 U.S.C. 154(b) by 170 days.

(21) Appl. No.: 16/214,617

(22) Filed: Dec. 10, 2018

(65) Prior Publication Data

US 2019/0178028 A1 Jun. 13, 2019

Related U.S. Application Data

(60) Provisional application No. 62/596,869, filed on Dec. 10, 2017.

(51) Int. Cl.

| | |
|---|---|
| ***E06B 11/00*** | (2006.01) |
| ***E06B 9/00*** | (2006.01) |
| ***E06B 9/08*** | (2006.01) |
| ***E06B 9/60*** | (2006.01) |
| ***E06B 11/02*** | (2006.01) |
| ***E06B 11/04*** | (2006.01) |
| ***E06B 9/11*** | (2006.01) |
| ***E06B 9/174*** | (2006.01) |
| ***E06B 9/80*** | (2006.01) |
| ***E06B 9/54*** | (2006.01) |

(52) U.S. Cl.

CPC ..... *E06B 9/08* (2013.01); *E06B 9/11* (2013.01); *E06B 9/174* (2013.01); *E06B 9/54* (2013.01); *E06B 9/60* (2013.01); *E06B 9/80* (2013.01); *E06B 11/027* (2013.01); *E06B 11/04* (2013.01); *E06B 2009/002* (2013.01); *E06B 2009/804* (2013.01)

(58) Field of Classification Search

CPC .... E06B 11/023; E06B 11/025; E06B 11/026; E06B 11/045; E06B 2009/543; E06B 2009/407; E06B 2009/3227; E06B 2009/1713; E06B 9/08; E06B 9/11; E06B 9/174; E06B 9/80; E06B 9/54; E06B 9/60; E06B 11/027; E06B 11/04; E06B 2009/804; E06B 2009/002; E06B 9/17; G03B 21/562; G03B 21/56; G03B 21/001

See application file for complete search history.

(56) References Cited

U.S. PATENT DOCUMENTS

| | | | | |
|---|---|---|---|---|
| 4,470,221 | A * | 9/1984 | Courtis | E05F 1/1075 49/331 |
| 6,111,693 | A * | 8/2000 | Crews | A63B 63/06 359/446 |
| 9,598,896 | B1 * | 3/2017 | Pichik | E06B 9/13 |
| 10,329,837 | B2 * | 6/2019 | Grutzner | E06B 9/32 |
| 2014/0158312 | A1 * | 6/2014 | Townsley | E06B 9/42 160/243 |
| 2015/0036949 | A1 * | 2/2015 | Lasagna | E04H 9/145 383/14 |
| 2018/0347275 | A1 * | 12/2018 | Horn | B66F 11/00 |

* cited by examiner

*Primary Examiner* — Daniel P Cahn
(74) *Attorney, Agent, or Firm* — Bruce A. Lev

(57) ABSTRACT

A retractable gate system structured and arranged to block off stairs and doorways with a simple pull and click by extending a sliding rail, pulling down mesh material, and clipping the device into bottom anchor hooks to instantly close off any opening thereby keeping kids and pets safe.

12 Claims, 5 Drawing Sheets

RETRACTABLE GATE SYSTEM

CROSS-REFERENCE TO RELATED APPLICATION

The present application is related to and claims priority from prior provisional application Ser. No. 62/596,869, filed Dec. 10, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of gate devices and more specifically relates to a retractable gate system structured and arranged to block off stairs and doorways with a simple pull and click by extending a sliding rail, pulling down mesh material, and clipping the device into bottom anchor hooks to instantly close off any opening thereby keeping kids and pets safe.

2. Description of the Related Art

Decks, staircases, bathrooms and porches—kids and pets love to wander into dangerous situations when our backs are turned. A baby gate or safety gate is a protective barrier designed to prevent babies and toddlers from accessing areas of a home where they might be unsafe, such as stairways and kitchens. Baby gates are typically constructed of metal, plastic and/or wood, and can be expanded to fit in a range of doorway widths. They may be designed for use indoors or out and may be either hardware or pressure-mounted. Pressure-mounted gates are typically held in place by friction with the walls on either side, while hardware-mounted gates are screwed into the wall studs and swing fully open like a door. There are hardware-mounted gates that can be customized to fit wide and irregularly shaped openings, as well as mesh retractable gates that roll out of the way.

Baby gates are also frequently used to contain small pets, especially ones that are not housebroken. A pet gate may not meet the voluntary standard for baby gates. Baby gates are typically removed once a child is capable of opening or climbing over the gate. Unfortunately, regular safety gates can be unsightly and unwieldy, making even adults struggle to get in and out.

Various attempts have been made to solve problems found in gate devices art. Among these are found in: U.S. Pat. No. 9,598,896 to Marc D Pichik; U.S. Pub. No. 2006/0113519 to Ian Prismall; U.S. Pat. No. 6,575,435 to Tracy A. Kotzen; U.S. Pat. No. 9,458,667 to Roger E. Bugh; and U.S. Pat. No. 7,384,017 to Burke et al. This prior art is representative of various retractable gate devices.

Ideally, a retractable gate system should be user-friendly and safe in-use and, yet would operate reliably and be manufactured at a modest expense. Thus, a need exists for a retractable gate system structured and arranged to block off stairs and doorways with a simple pull and click by extending a sliding rail, pulling down mesh material, and clipping the device into bottom anchor hooks to instantly close off any opening thereby keeping kids and pets safe and to avoid the above-mentioned problems.

BRIEF SUMMARY OF THE INVENTION

In view of the foregoing disadvantages inherent in the known gate device art, the present invention provides a novel Retractable Gate System. The general purpose of the present invention, which will be described subsequently in greater detail is to provide a retractable gate system structured and arranged to block off stairs and doorways with a simple pull and click by extending a sliding rail, pulling down mesh material, and clipping the device into bottom anchor hooks to instantly close off any opening thereby keeping kids and pets safe.

A retractable gate system comprising: an elongated housing; roller member; a flexible panel member; upper connector member; and two lower connector members. The elongated housing includes: at least one exterior wall defining a hollow interior volume having a length and at least one open end. Wherein the elongated housing is adapted to be attached to a portion of a fence or railing adjacent an opening thereof.

The roller member including: an elongated spindle having a length and opposite end portions; two rollers; and an attachment portion. Wherein the two rollers are rotatably attached to respective opposite end portions of the elongated spindle, such that the spindle can rotate with respect to the two rollers. Wherein the attachment portion is connected to an outside surface of one of the two rollers and adapted to releasably connect with an upper connector member attached to an upper section of the fence or railing. Wherein the roller member has a length smaller than the length of the interior volume of the elongated housing and is adapted to be slidably stored therein.

The flexible panel member includes: a first edge connected to the elongated spindle and an elongated connector rod including opposite end sections. Wherein the elongated connector rod is connected to a second edge of the flexible panel member located opposite from the first edge. Wherein the elongated connector rod is adapted to extend parallel to the elongated spindle of the roller member. Wherein the flexible panel member is adapted to be rolled upon the elongated spindle of the roller member when in a stored configuration and extended from the elongated spindle of the roller member when in an in-use configuration.

Wherein the upper connector member is adapted to be attached to an upper section of the fence or railing adjacent the opening thereof opposite from the portion that the elongated housing is adapted to be attached to, such that when in the in-use configuration the roller member can be positioned between the portions of the fence or railing and across the opening therebetween.

Wherein the two lower connector members are adapted to be attached to lower sections of the fence or railing adjacent the opening thereof. Wherein the two lower connector members are adapted to releasably connect with respective opposite end sections of the elongated connector rod of the flexible panel member.

Wherein when in the stored configuration the flexible panel member is rolled up upon the roller member, and the roller member and the flexible panel member are stored within the elongated housing. Wherein when deploying the retractable gate system into the in-use configuration the roller member and the flexible panel member are slid out from the elongated housing, extended outwardly therefrom until the attachment portion can releasably connect with the upper connector member thereby extending between the portions of the fence or railing, then the flexible panel member is rolled out from the roller member until the elongated connector rod is able to releasably connect with the two lower connector members to thereby releasably cover the opening between the portions of the fence or railing. Wherein when removing the flexible panel member from between the portions of the fence or railing the elongated connector rod is disconnected from the two lower connector members, rolled back upon the roller member, the attachment portion is disconnected from the upper connector member, and the roller member and the flexible panel member are slid back into the elongated housing and into the stored configuration.

The present invention holds significant improvements and serves as a Retractable Gate System. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a Retractable Gate System, constructed and operative according to the teachings of the present invention.

The various embodiments of the present invention will hereinafter be described in conjunction with the appended drawings, wherein like designations denote like elements.

DETAILED DESCRIPTION

Figure 1:
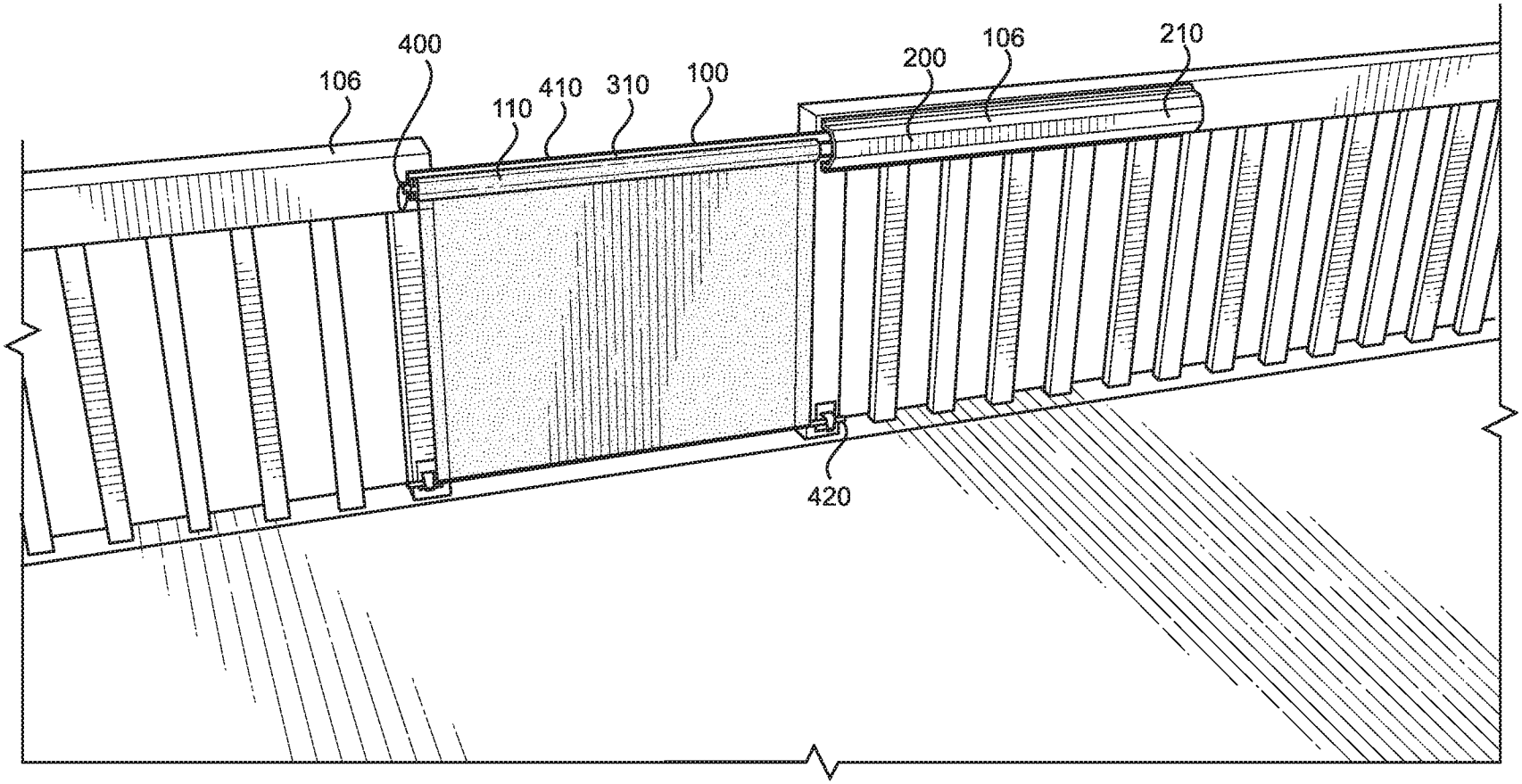
FIG. 1 shows a perspective view illustrating a retractable gate system in an in-use condition according to an embodiment of the present invention.

As discussed above, embodiments of the present invention relate to a gate device and more particularly to a retractable gate system structured and arranged to block off stairs and doorways with a simple pull and click by extending a sliding rail, pulling down mesh material, and clipping the device into bottom anchor hooks to instantly close off any opening thereby keeping kids and pets safe.

Generally speaking, the retractable gate system comprising a novel product offering consumers a practical solution to the aforementioned challenges. As the name implies, the retractable gate system comprises a specially designed retractable gate system which may function as a permanent safety gate for a porch. The gate may be adjustable and have 3 latches that attach to a deck. A user may simply pull open when needing to use to click the 3 latches to securely lock the gate into position in order to keep kids or animals on/off a deck. To use, a user can just extend the sliding rail, pull down the mesh material, and clip into the bottom anchor hooks to instantly close off any opening. The present invention is a simple way to keep your kids and pets safe.

Easy to use and packed with features and benefits:

- Durable mesh material snaps quickly into the bottom anchor hooks to secure the gate
- Telescoping rail and cover lets you compactly store the gate when not in use
- Works with wider than normal openings
- Available in multiple colors to match your décor
- Can be installed directly onto the hand-railing or fence pillars of a deck
- Simple to install and use—opens and closes in seconds Fast to install and a snap to use:

1. Attach the gate cover beside the opening
2. Extend the telescoping rail and click into place
3. Pull down the mesh material
4. Securely latch into the bottom anchors Referring to the drawings by numerals of reference there is shown in FIGS. 1-7, perspective views illustrating retractable gate system 100 according to an embodiment of the present invention.

Figure 2:
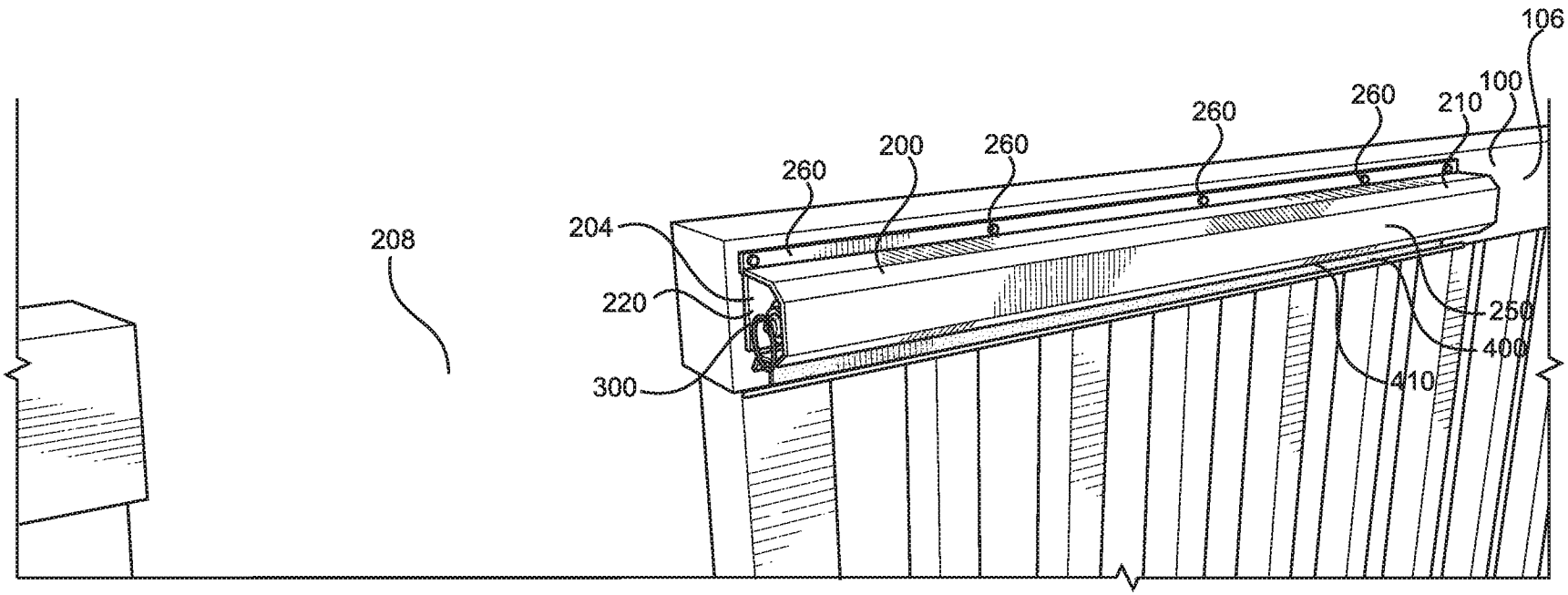
FIG. 2 is a perspective view illustrating an elongated housing and a flexible panel in a stored configuration of the retractable gate system according to an embodiment of the present invention of FIG. 1.

Retractable gate system 100 comprising: elongated housing 200; roller member 300; flexible panel member 400; upper connector member 500; and two lower connector members 600. Elongated housing 200 includes: at least one exterior wall 210 defining hollow interior volume 220 having a length and at least one open end 204 as shown in FIG. 2. Wherein elongated housing 200 is adapted to be attached to a portion of a fence or railing 106 adjacent opening 208 thereof. Wherein said elongated housing 200 is formed from a material chosen from a group of materials consisting of sheet metal and plastic.

The retractable gate system further comprising plurality of fasteners 260 adapted to releasably connect elongated housing 200 to a portion of fence or railing 106 adjacent opening 208.

Figure 3:
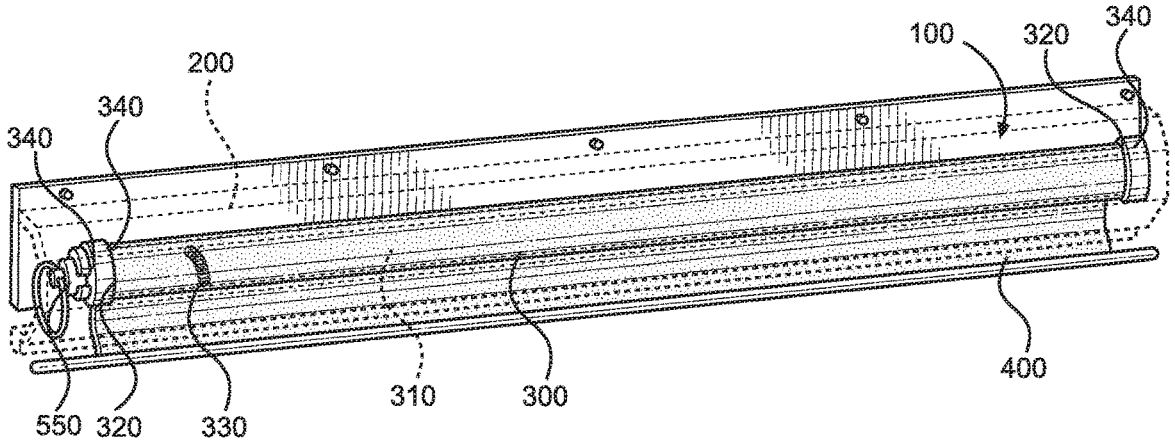
FIG. 3 is a perspective view illustrating a roller member stored inside the elongated housing of the retractable gate system according to an embodiment of the present invention of FIG. 1.
Figure 5:
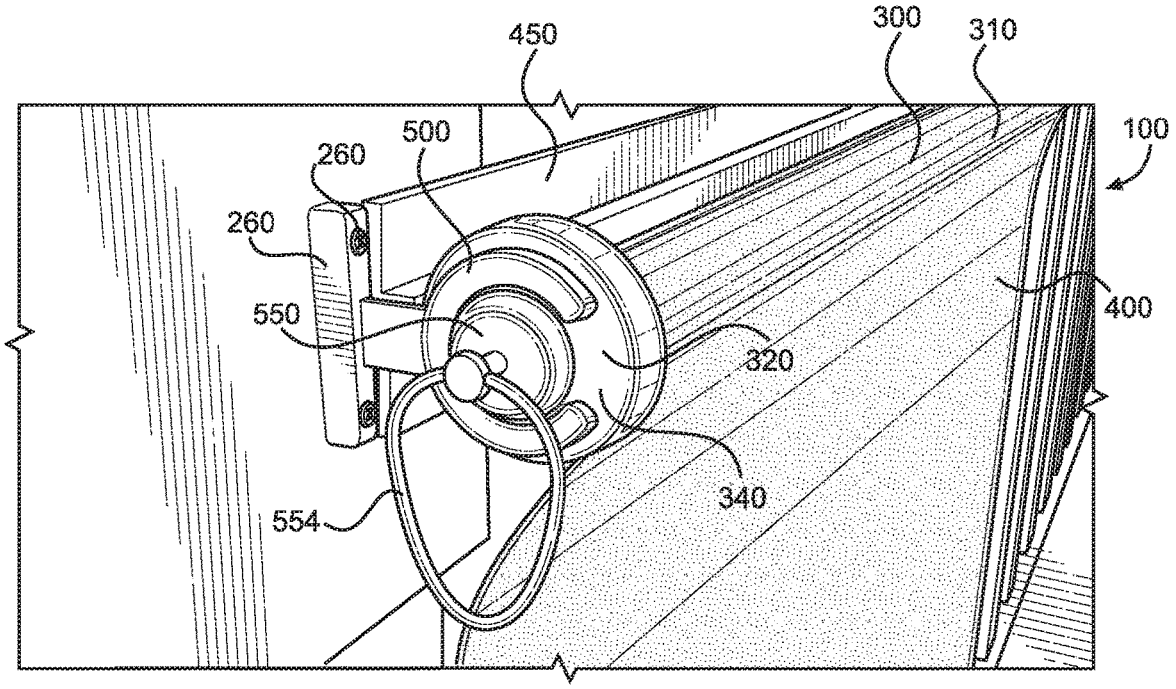
FIG. 5 is a perspective view illustrating an upper connector member of the retractable gate system according to an embodiment of the present invention of FIG. 1.
Figure 7:
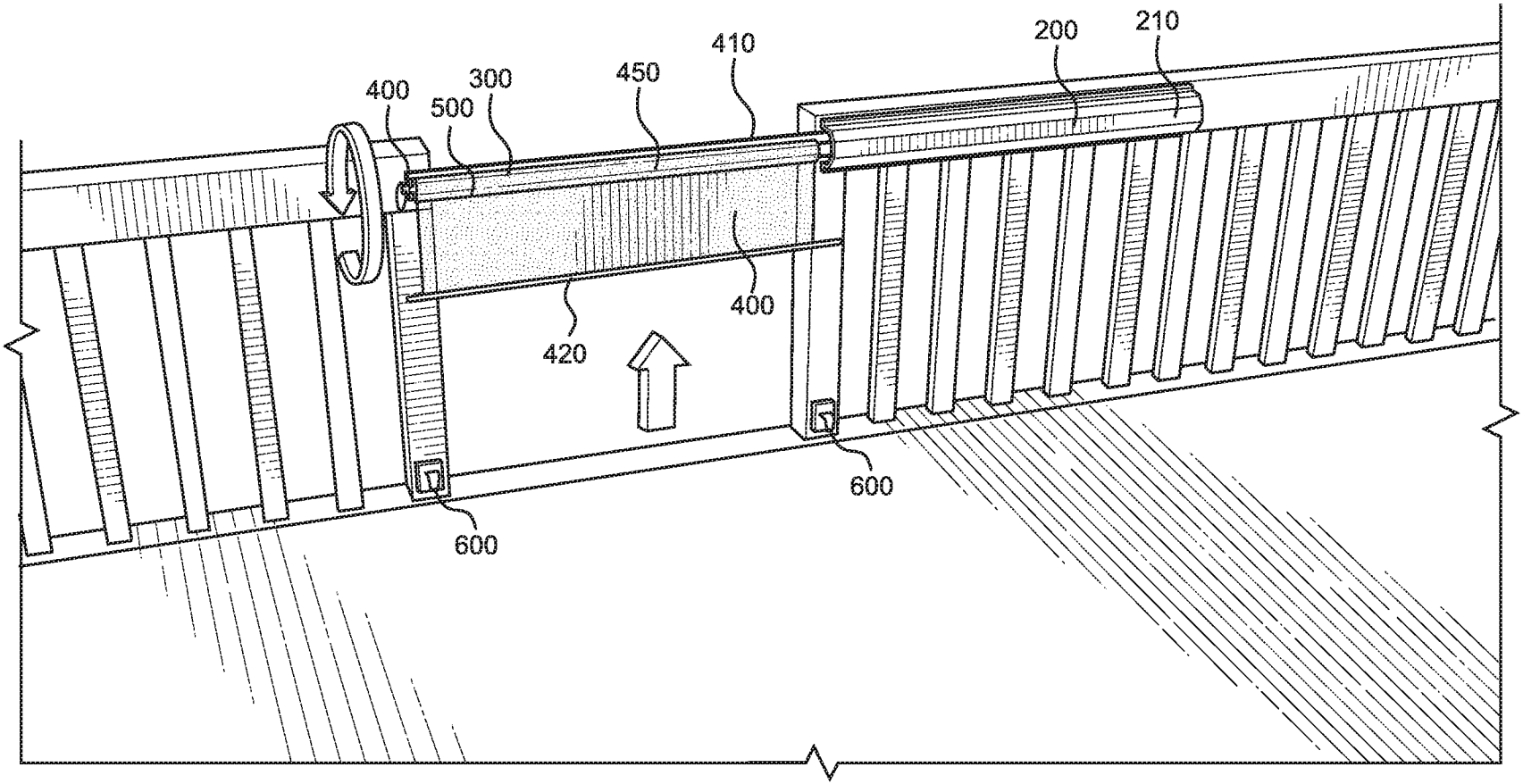
FIG. 7 is a perspective view illustrating the flexible panel being released from lower connector member and being rolled up upon the roller member of retractable gate system according to an embodiment of the present invention of FIG. 1.

Roller member 300 including: elongated spindle 310 having a length and opposite end portions 320; two rollers 340; and attachment portion 550 as shown in FIG. 3. Wherein two rollers 340 are rotatably attached to respective opposite end portions of elongated spindle 310, such that spindle 310 can rotate with respect to two rollers 340. Wherein attachment portion 550 is connected to an outside surface of one of the two rollers 340 and adapted to releasably connect with an upper connector member 500 attached to an upper section of the fence or railing 106 as shown in FIG. 5.

Wherein roller member 300 has a length smaller than the length interior volume 220 of elongated housing 200 and is adapted to be slidably stored therein. Wherein roller member 300 further includes at least one spring member 330 in between spindle member 310 and at least one of two roller members 340, such that when flexible panel member 400 is rolled out from roller member 300 it becomes biased by at least one spring member 330, and when it is desired to roll flexible panel member 400 back onto roller member 300 at least one spring member 300 biases and rotates spindle member 310 to thereby roll flexible panel member 400 back onto roller member 300 as shown in FIG. 7. Retractable gate system 100 further comprising handle member 554 attached to an outside surface of attachment portion 550 as shown in FIG. 5.

Figure 4:
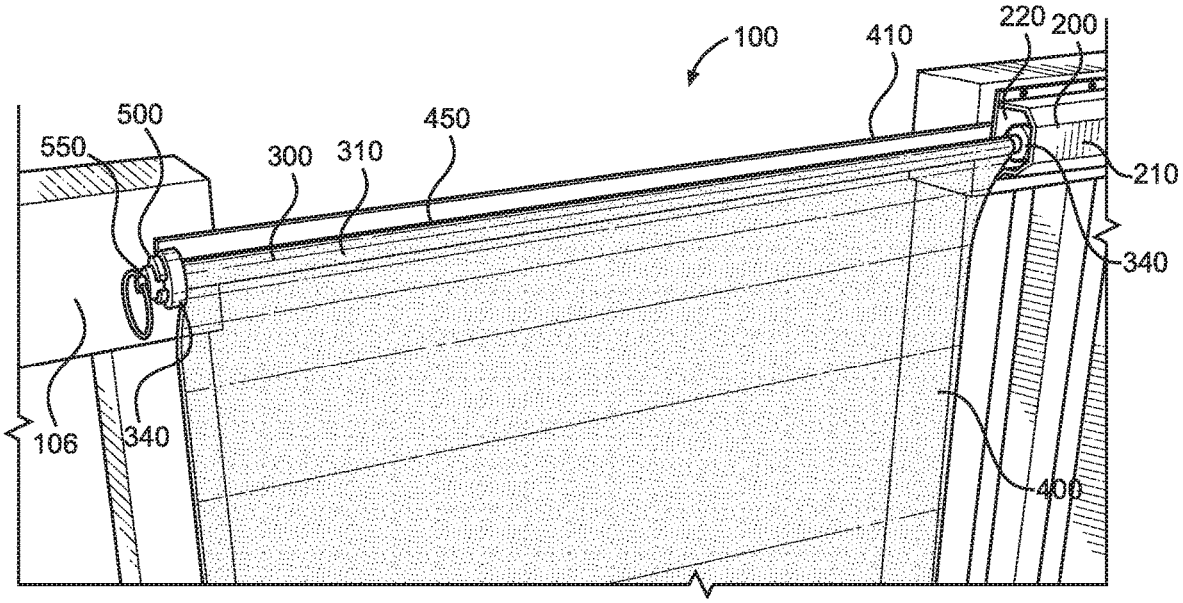
FIG. 4 is a perspective view illustrating a flexible panel connected to an elongated spindle of the roller member of the retractable gate system connecting with an upper connector member according to an embodiment of the present invention of FIG. 1.

Retractable gate system 100 further comprising elongated rail member 450 adapted to slide within elongated housing 200, is connected to outside surface of rollers 340 that attachment portion 550 of roller member 300 is connected to, and is adapted to provide rigidity and support to roller member 300 when retractable gate system 100 is in in-use configuration 110 as shown FIG. 4. Wherein elongated rail member 450 has a length substantially equal to the length of elongated spindle 310. Wherein elongated rail member 450 is formed from a plurality of telescoping rail portions, such that elongated rail member 450 is adjustable in length.

Figure 6:
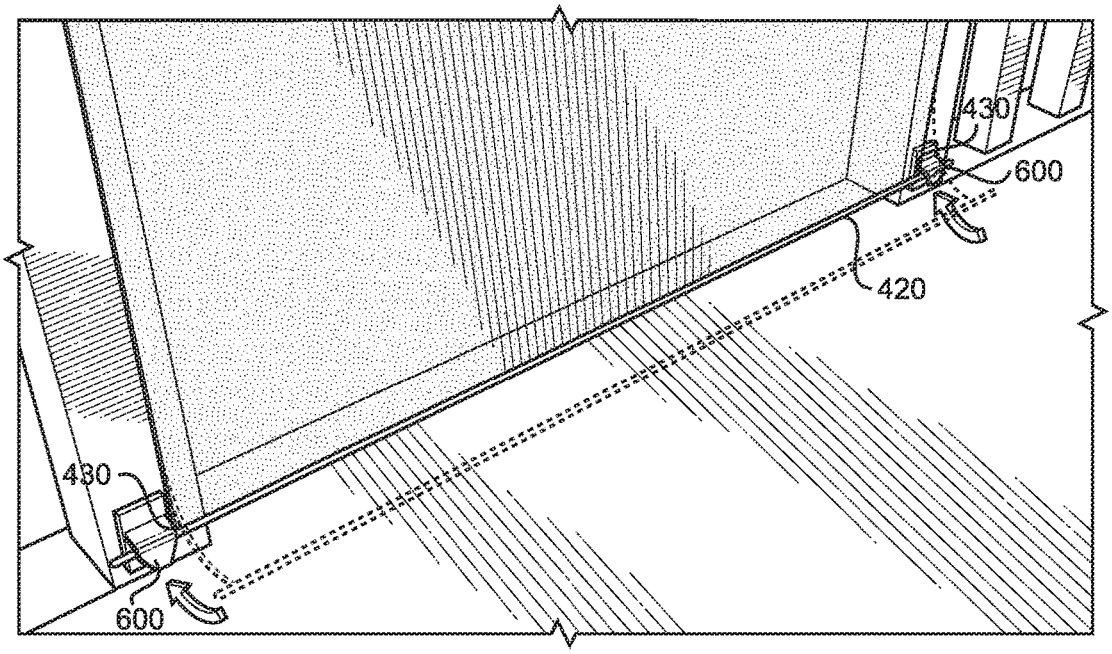
FIG. 6 is a perspective view illustrating a bottom portion showing a lower connector member of retractable gate system according to an embodiment of the present invention of FIG. 1.

Flexible panel member 400 includes: first edge 410 connected to elongated spindle 310 and elongated connector rod 420 including opposite end sections 430. Wherein elongated connector rod 420 is connected to second edge 440 of flexible panel member 400 located opposite from first edge 410. Wherein elongated connector rod 420 is adapted to extend parallel to the elongated spindle 310 of roller member 300. Wherein flexible panel member 400 is adapted to be rolled upon elongated spindle 310 of roller member 300 when in stored configuration 250 and extended from elongated spindle 310 of roller member 300 when in in-use configuration 110. Wherein flexible panel member 400 is formed from a mesh material.

Wherein upper connector member 500 is adapted to be attached to an upper section of fence or railing 106 adjacent opening 208 thereof opposite from the portion that elongated housing 200 is adapted to be attached to, such that when in in-use configuration 110 roller member 300 can be positioned between the portions of the fence or railing 106 and across opening 208 therebetween. Wherein upper connector member 500 is formed as a C-shaped clip as shown in FIG. 5. Wherein attachment portion 550 of roller member 300 is formed having a circular shape adapted to fit within and releasably connect to upper connector member 500 as shown in FIG. 5.

Wherein two lower connector members 600 are adapted to be attached to lower sections of the fence or railing 106 adjacent opening 208 thereof. Wherein two lower connector members 600 are adapted to releasably connect with respective opposite end sections of elongated connector rod 420 of flexible panel member 400. Wherein two lower connector members 600 are formed as hooks as shown in FIG. 6.

Wherein when in stored configuration 250 flexible panel member 400 is rolled up upon roller member 300, and roller member 300 and flexible panel member 400 are stored within elongated housing 200. Wherein when deploying retractable gate system 100 into in-use configuration 110 roller member 300 and flexible panel member 400 are slid out from the elongated housing 200, extended outwardly therefrom until attachment portion 550 can releasably connect with upper connector member 500 thereby extending between the portions of the fence or railing 106, then flexible panel member 400 is rolled out from roller member 300 until elongated connector rod 420 is able to releasably connect with the two lower connector members 600 to thereby releasably cover opening 208 between the portions of the fence or railing 106. Wherein when removing flexible panel member 400 from between the portions of the fence or railing 106 elongated connector rod 420 is disconnected from two lower connector members 600, rolled back upon roller member 300, attachment portion 550 is disconnected from upper connector member 500, and roller member 300 and flexible panel member 400 are slid back into elongated housing 200 and into stored configuration 250.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application,

What is claimed is:

1. A retractable gate system comprising:

an elongated housing including at least one exterior wall defining a hollow interior volume having a length and at least one open end;

wherein said elongated housing is attachable to a first upper portion of a fence or railing adjacent an opening thereof;

a roller member including an elongated spindle having a length and opposite end portions;

a first roller and a second roller;

wherein said first roller and said second roller are rotatably attached respectively to said opposite end portions of said elongated spindle, such that said spindle can rotate with respect to said first roller and said second roller;

wherein said first roller has an outside surface and said second roller has an outside surface; and an attachment portion;

wherein said attachment portion is connected to said outside surface of one of said first roller and said second roller and releasably connects with an upper connector member attached to a second upper section of said fence or railing;

wherein said roller member has a length smaller than said length of said interior volume of said elongated housing and is adapted to be slidably stored therein;

a flexible panel member including a first edge connected to said elongated spindle; and an elongated connector rod including opposite end sections;

wherein said elongated connector rod is connected to a second edge of said flexible panel member located opposite from said first edge; and wherein said elongated connector rod is adapted to extend parallel to said elongated spindle of said roller member;

wherein said flexible panel member is adapted to be rolled upon said elongated spindle of said roller member when in a stored configuration and extended from said elongated spindle of said roller member when in an in-use configuration;

wherein said upper connector member is attachable to said second upper section of said fence or railing adjacent said opening thereof opposite from said first upper portion that said elongated housing is attachable such that, when in said in-use configuration, said roller member can be positioned between said first upper portion and said second upper portion of said fence or railing and across said opening therebetween; and a first lower connector member and a second lower connector member;

wherein said first lower connector member is attachable to a first lower section of said fence or railing;

wherein said first lower section of said fence is adjacent said opening thereof;

wherein said second lower connector member is attachable to a second lower section of said fence or railing adjacent said opening thereof;

wherein said second lower section of said fence is adjacent said opening thereof opposite said first lower section of said fence; and wherein said first lower connector member and said second lower connector member are releasably connectable connect with respective said opposite end sections of said elongated connector rod of said flexible panel member;

wherein when in said stored configuration said flexible panel member is rolled up upon said roller member, and said roller member and said flexible panel member are stored within said elongated housing;

wherein when deploying said retractable gate system into said in-use configuration said roller member and said flexible panel member are slid out from said elongated housing, extended outwardly therefrom until said attachment portion can releasably connect with said upper connector member thereby extending between said first upper portion and said second upper portion of said fence or railing, then said flexible panel member is rolled out from said roller member until said elongated connector rod is able to releasably connect with said first lower connector member and said second lower connector member to thereby releasably cover said opening between said portions of said fence or railing; and wherein when removing said flexible panel member from between said portions of said fence or railing said elongated connector rod is disconnected from said first lower connector member and said second lower connector member, rolled back upon said roller member, said attachment portion is disconnected from said upper connector member, and said roller member and said flexible panel member are slid back into said elongated housing and into said stored configuration.

2. The retractable gate system of claim 1, wherein said roller member further comprises:

at least one spring member operably connected in between said spindle and at least one of said first roller and said second roller, such that when said flexible panel member is rolled out from said roller member it becomes biased by said at least one spring member, and when it is desired to roll said flexible panel member back onto said roller member said at least one spring member biases and rotates said spindle to thereby roll said flexible panel member back onto said roller member.

3. The retractable gate system of claim 1, further comprising:

an elongated rail member adapted to slide within said elongated housing, wherein said elongated rail member is connected to said outside surface of said first roller or said outside surface of said second roller that said attachment portion of said roller member is connected to, and is adapted to provide rigidity and support to said roller member when said retractable gate system is in said in-use configuration.

4. The retractable gate system of claim 3, wherein said elongated rail member has a length substantially equal to said length of said elongated spindle.

5. The retractable gate system of claim 4, wherein said elongated rail member is formed from a plurality of telescoping rail portions, such that said elongated rail member is adjustable in length.

6. The retractable gate system of claim 1, further comprising:

a handle member attached to an outside surface of said attachment portion.

7. The retractable gate system of claim 1, wherein said upper connector member is formed as a C-shaped clip.

8. The retractable gate system of claim 7, wherein said attachment portion of said roller member is circular and adapted to fit within and releasably connect to said upper connector member.

9. The retractable gate system of claim 1, further comprising a plurality of fasteners adapted to releasably connect said elongated housing to said first upper portion of said fence or railing adjacent said opening.

10. The retractable gate system of claim 1, wherein said flexible panel member is formed from a mesh material.

11. The retractable gate system of claim 1, wherein said first lower connector member and said second lower connector member are formed as hooks.

12. The retractable gate system of claim 1, wherein said elongated housing is formed from a material chosen from a group consisting of metal and plastic.

* * * * *